US009145754B2

(12) United States Patent
Johansson

(10) Patent No.: US 9,145,754 B2
(45) Date of Patent: Sep. 29, 2015

(54) TUBING HANGER WITH COUPLING ASSEMBLY

(71) Applicant: Aker Subsea AS, Lysaker (NO)

(72) Inventor: Robert Johansson, Oslo (NO)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 14/359,566

(22) PCT Filed: Nov. 22, 2012

(86) PCT No.: PCT/EP2012/073342
§ 371 (c)(1),
(2) Date: May 20, 2014

(87) PCT Pub. No.: WO2013/079390
PCT Pub. Date: Jun. 6, 2013

(65) Prior Publication Data

US 2014/0345873 A1 Nov. 27, 2014

(30) Foreign Application Priority Data

Nov. 30, 2011 (NO) ..... 20111652

(51) Int. Cl.
*E21B 33/043* (2006.01)

(52) U.S. Cl.
CPC ..... *E21B 33/043* (2013.01)

(58) Field of Classification Search
CPC ..... E21B 33/04; E21B 33/03; E21B 33/035; E21B 33/043; E21B 34/04; E21B 34/02; E21B 41/0007; E21B 34/102; E21B 33/0355; E21B 33/038; E21B 33/0385
USPC ..... 251/149.6, 251, 253, 263, 359, 257
See application file for complete search history.

(56) References Cited

U.S. PATENT DOCUMENTS 3,719,070 A * 3/1973 Hanes ..... 73/37
3,851,897 A * 12/1974 Piazza et al. ..... 285/18
4,306,742 A 12/1981 Hardcastle (Continued)

FOREIGN PATENT DOCUMENTS

EP 2239412 A2 10/2010
GB 2184508 A 6/1987

(Continued)

OTHER PUBLICATIONS

Schneiderbauer, K., International Search Report, prepared for PCT/EP2012/073342, as mailed Dec. 13, 2013, 4 pages.

*Primary Examiner* — James G Sayre
(74) *Attorney, Agent, or Firm* — Winstead PC

(57) ABSTRACT

A tubing hanger (1) landing in a tubular element (101), having a coupling assembly (11) for hydraulic coupling between the tubing hanger (1) and the element. A coupling element (17) moves radially between an outer coupled position and an inner non-coupled position. An actuation element (25) with a contact surface (25*f*) exerts an outward actuation force onto an inner actuation surface (17*a*) of the coupling element. The actuation element comprises two actuation sections (25*x*, 25*y*) exposed to a outward force from an actuation arrangement (27). The contact surface (25*f*) has a distance the actuation sections. The actuation element moves in the radial outward direction so that the movement of at least one of the two actuation sections (25*x*, 25*y*) stops after the radial movement of the contact surface (25*f*) stops. The contact surface (25*f*) movement halts as the coupling element (17) reaches the coupled position.

6 Claims, 13 Drawing Sheets

(56) References Cited

U.S. PATENT DOCUMENTS

| | | | | |
|---|---|---|---|---|
| 4,796,922 | A * | 1/1989 | Prichard | 285/26 |
| 4,852,611 | A * | 8/1989 | Knerr et al. | 137/595 |
| 5,456,321 | A | 10/1995 | Shiach et al. | |
| 5,671,812 | A | 9/1997 | Bridges | |
| 6,158,716 | A * | 12/2000 | Wilkins et al. | 251/149.6 |
| 6,609,734 | B1 * | 8/2003 | Baugh | 285/322 |
| 8,678,093 | B2 * | 3/2014 | Willoughby | 166/338 |
| 2002/0170721 | A1 | 11/2002 | June | |
| 2013/0068466 | A1 * | 3/2013 | Ghumre et al. | 166/348 |

FOREIGN PATENT DOCUMENTS

| | | | |
|---|---|---|---|
| GB | 2448262 | A | 10/2008 |
| WO | WO-01/73256 | A1 | 10/2001 |
| WO | WO-2005010319 | A1 | 2/2005 |
| WO | WO-2005068775 | A1 | 7/2005 |
| WO | WO-2010/032019 | A1 | 3/2010 |
| WO | WO-2010080294 | A2 | 7/2010 |

* cited by examiner

TUBING HANGER WITH COUPLING ASSEMBLY

The present invention relates to a tubing hanger with a coupling assembly which is adapted to establish hydraulic coupling with an oppositely arranged counterpart on an inner face of a tubular element, such as a Xmas tree.

BACKGROUND

In the oil industry and particularly in the subsea field, it is common to provide arrangements that can connect and disconnect electric connections and fluid connections remotely. For instance, hydraulic connections and channels are used to control pressures and to provide mechanical movement of equipment, such as locking and unlocking of latches and valves. Furthermore, electrical connections and communication paths are provided for measurement of e.g. temperatures and pressures.

An example of such remotely (diverless or even ROV-less) established connections is the connections between a tubing hanger which is landed in the spool of a Christmas tree (XT) and the XT itself. Patent publication U.S. Pat. No. 6,158,716 describes a tubing hanger (TH) having a plurality of radially actuated coupling elements. On the radially outwardly facing side, the coupling elements have an interface adapted for engagement (i.e. abutment) with a facing counterpart arranged in the XT spool. As the TH is landed in the XT spool, the coupling elements are moved radially into engagement with the counterpart to establish sealed hydraulic couplings. The ends of hydraulic channels of the coupling elements and facing counterparts are aligned and a surrounding sealing is encircling the said facing channel ends. The appurtenant FIG. 3 is from U.S. Pat. No. 6,158,716, and shows the coupling element (20) arranged in the tubing hanger.

The sealing of the solution described in the patent publication U.S. Pat. No. 6,158,716 is established by forcing a seal carrying part (the coupling element 20) against a sealing surface (cf. sealing surface 203 of the prior art FIG. 3) of the facing part. Due to the substantial pressures which may be present in equipment associated with subsea wells, the two facing parts are forced against each other with a considerable force to ensure proper sealing. This force needs to be above a lower threshold in order to ensure the sealing function, as well as to be below an upper threshold in order to maintain the mechanical integrity of the associated parts. Hence one needs a solution which provides a pre tension between a selected upper and lower force limit.

Another goal when forcing the coupling element radially into sealing engagement with the counterpart, is to force it in a strict radial direction with the resultant force in the axial centre of the coupling element. That is, one needs to ensure that the sealing surface is forced against the facing counterpart with an even pressure throughout the area of the sealing surface.

THE INVENTION

According to a first aspect of the invention, there is provided a tubing hanger adapted to land in a tubular element, such as a Xmas tree, and comprising a coupling assembly which is adapted for establishment of a hydraulic coupling between the tubing hanger and the tubular element. According to the invention, the coupling assembly comprises a coupling element adapted to move radially between an outer coupled position and an inner non-coupled position. The term radially is with respect to an axially running centre axis of the tubular element and/or the tubing hanger itself. The coupling element exhibits an outer surface adapted to establish said hydraulic coupling with an opposite and inwardly facing surface of the tubular element when forced against it. The said inwardly facing surface of the tubular element may very well be the surface of a component attached to the tubular element, such as a penetrator arranged in a wall of the tubular element. The coupling element comprises a hydraulic channel adapted to align with a hydraulic channel in the tubular element. The coupling element comprises a radially inner actuation surface.

Furthermore, according to the present invention, the coupling assembly also comprises an actuation element having a contact surface which is adapted to exert an actuation force onto the inner actuation surface in a radially outward direction. The actuation element exhibits an elongated shape and comprises two actuation sections which are adapted to be exposed to a radially outward directed force from an actuation arrangement. The contact surface is arranged with a distance from both of said actuation sections. The actuation element is adapted to be moved in the radial outward direction in such way that the movement of at least one of the two actuation sections will stop after the radial movement of the contact surface has stopped. The movement of the contact surface is halted when the coupling element reaches the coupled position.

The actuation element will thus function as a leaf spring, maintaining a radial outward directed force onto the coupling element. As will be appreciated by the person skilled in the art, the preload will be determined by the spring stiffness.

The distance between the contact surface and the two actuation sections is preferably a distance along the axial direction. However, the distance could also be in a tangential direction.

With the term elongated shape of the actuation element is to be understood a shape of its cross section which is sufficiently thin with respect to its extension in the radial and/or tangential direction, which makes the actuation element flexible. The flexibility of the actuation element has the function of making the movement of one of the said actuation sections possible when the movement of the contact surface has been halted. This additional movement will result in a preloading of the coupling element in the radial outward direction, i.e. towards the facing tubular element. Thus the actuation element could e.g. be a flexible bar-shaped component or a flexible plate-shaped component.

In one embodiment, the actuation element comprises two parallel inclined surfaces which are adapted to slide simultaneously along two facing inclined surfaces of the actuation arrangement. In this way the actuation element does not alter its orientation. It will only alter its position, as it is moved radially outwards by engagement with the actuation arrangement. Strictly speaking, the two actuation sections of the actuation element will however move a bit further than its contact surface, due to the preload function as discussed above.

The contact surface of the actuation element or the inner surface of the coupling element may exhibit a spherical or convex, curved shape. Preferably the coupling element exhibits such a surface. As will be described in the example of embodiment further below, this features ensures a central positioning of the forces between the actuation element and the coupling element. This will further ensure an even force distribution between the coupling element and the facing surface of the tubular element.

In the coupled position two supporting surfaces of the actuation arrangement can be adapted to abut against oppositely arranged and parallel extending actuation surfaces of the actuation element. Of the said parallel extending actuation surfaces one is arranged on each actuation section. In this embodiment, the supporting surfaces of the actuation arrangement and the actuation surfaces of the actuation element are preferably in parallel with an axially extending centre axis of the tubing hanger. In this way there will not arise axially directed forces between the actuation arrangement and the actuation element.

According to an embodiment the coupling assembly is designed in such manner that during a first actuation of the coupling assembly, the actuation element is adapted to deform both in an elastic and plastic manner when the at least one of the two actuation sections moves a distance after the movement of the contact surface stops. This feature makes the actuation element adapt to the other parts of the coupling assembly and the tubular element when being used the first time.

Although the tubing hanger according to the invention is particularly advantageous in connection with subsea wells, it may also be employed in association with onshore wells, as will be appreciated by the person skilled in the art.

EXAMPLE OF EMBODIMENT

While the main features of the present invention have been described above, a more detailed example of embodiment will now be described with reference to the drawings, in which FIG. 1 shows the lower part of a tubing hanger, which is provided with the coupling assembly according to the invention in a non-coupled position;

Figure 1:
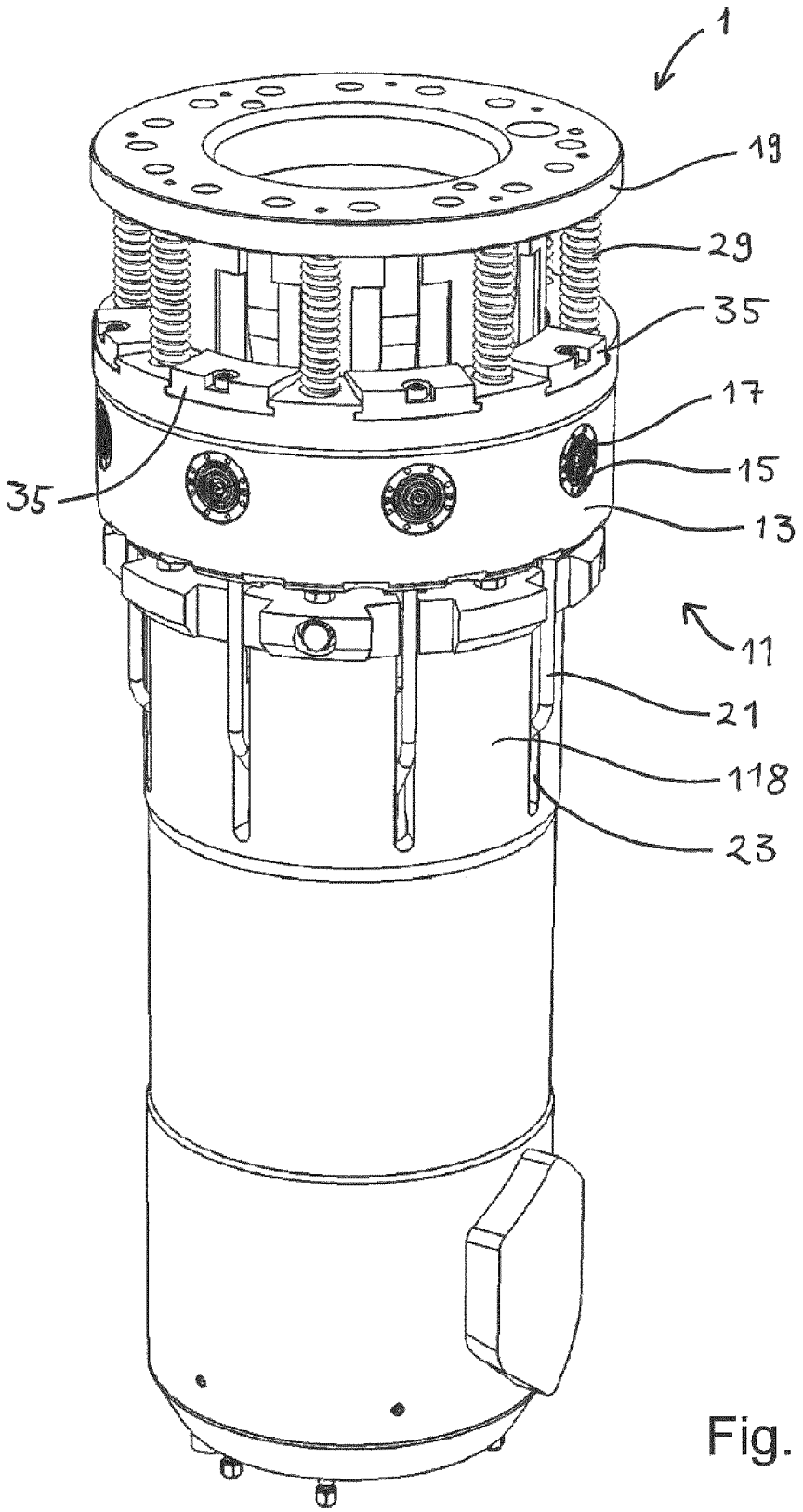

FIG. 1 shows a tubing hanger (TH) 1 (actually it is a lower part or a penetrator assembly of a tubing hanger, it is however referred to as a tubing hanger herein for simplicity) provided with a coupling assembly 11 according to the present invention. The coupling assembly 11 has a carrier ring 13 that extends about the circumference of the TH 1. The carrier ring 13 has a plurality of holes 15 that extend through the carrier ring 13 in a radial direction. Within the holes 15 of the carrier ring 13 there are arranged coupling elements 17. The coupling elements 17 are adapted to slide back and forth in a radial direction within the holes 15 of the carrier ring 13. Through the carrier ring 13 extends a main body 19. At the upper end of the main body 19 is connected to additional parts (not shown) of the TH. The carrier ring 13 is reciprocally suspended on the main body 19, in such way that the carrier ring 13 and the main body 19 can move with respect to each other in the axial direction. This movement takes place during coupling and decoupling of the coupling assembly 11.

At the lower section of the tubing hanger 1 shown in FIG. 1 there is an orientation sleeve 118.

Figure 4:
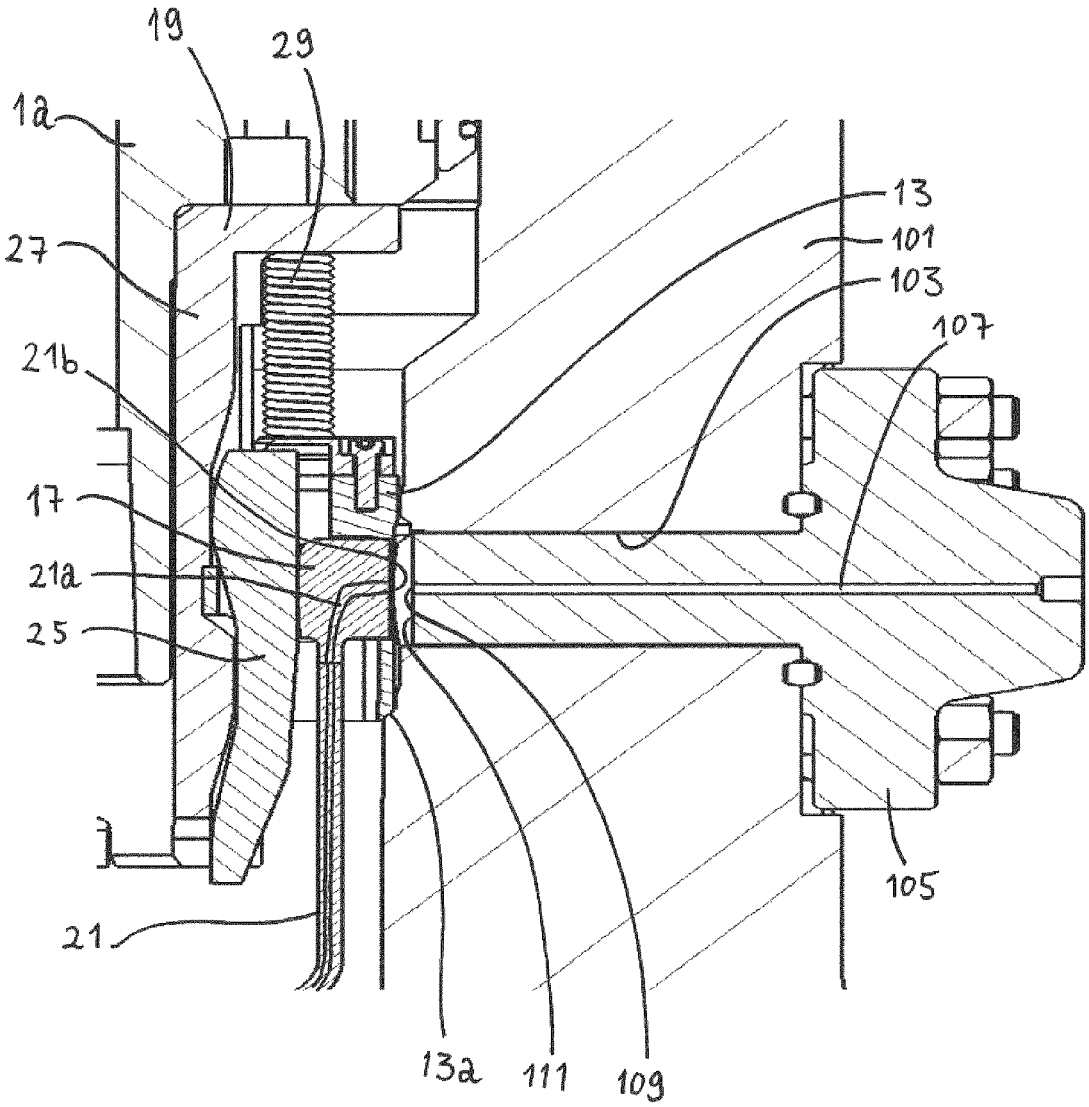
FIG. 4 is an enlarged cross section view of parts of the coupling assembly according to the invention, in a non-coupled state.
Figure 5:
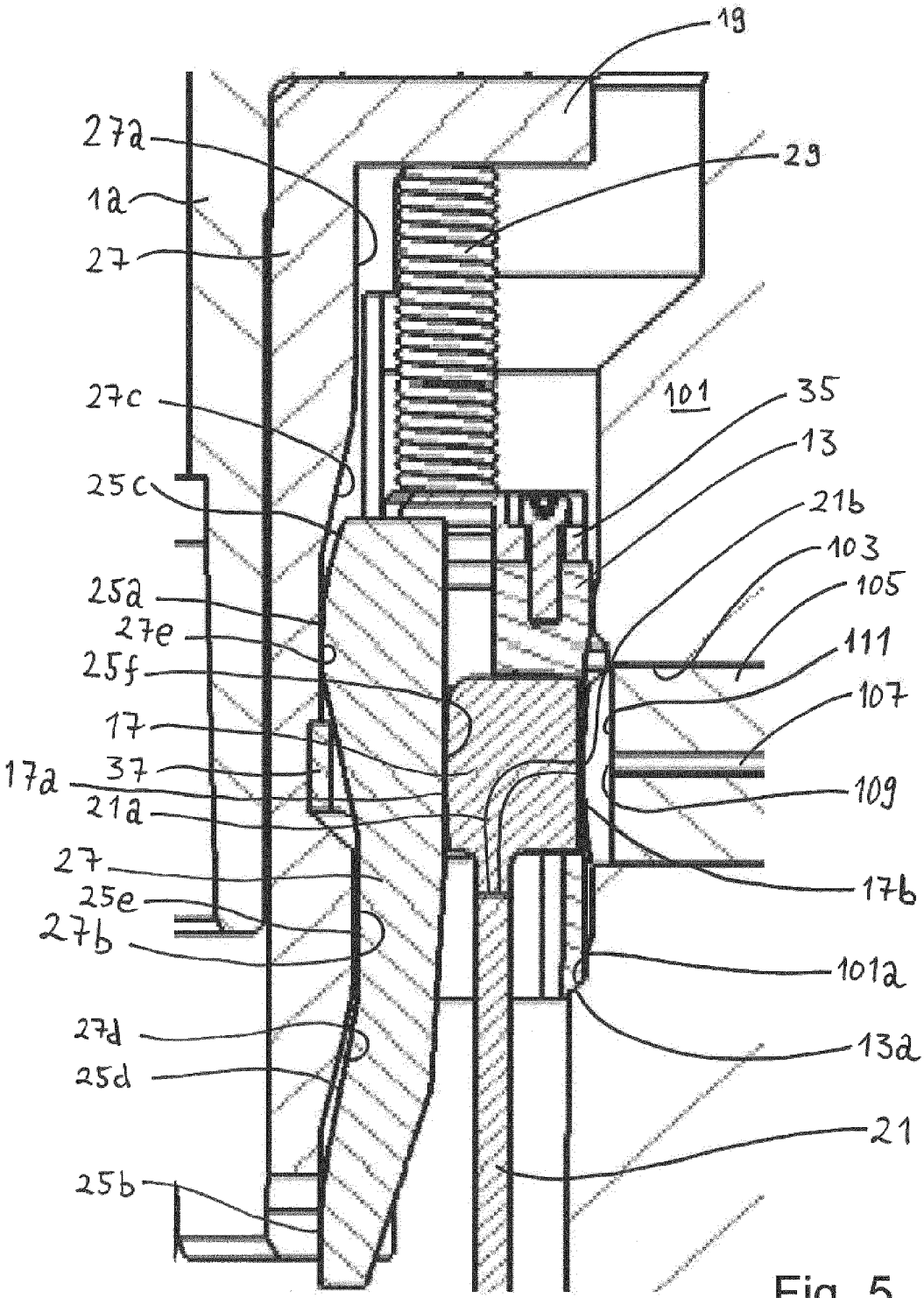
FIG. 5 is a more detailed cross section view of the coupling assembly shown in FIG. 4, in the non-coupled state.
Figure 6:
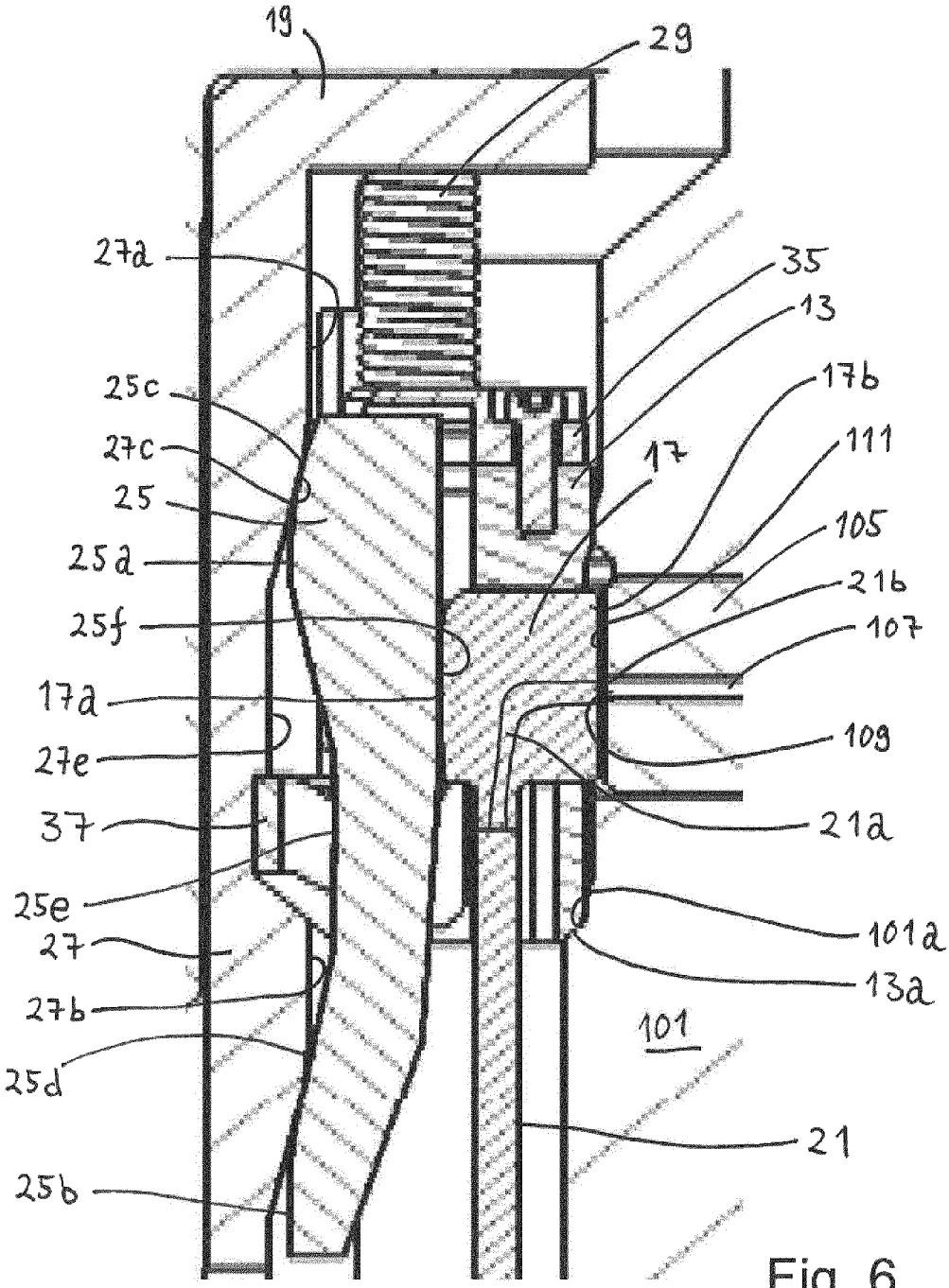
FIG. 6 is the same cross section view as FIG. 5, however with the coupling assembly in an intermediate state.

When the TH 1 is arranged within a tubular element, such as the spool of a XT (not shown in FIG. 1 and FIG. 2), the coupling elements 17 will be forced in a radial outward direction and into sealing contact with a facing counterpart (cf. FIG. 4 to FIG. 6). When the TH 1 shall be retrieved, the coupling elements 17 will be moved back, in a radial inwards direction, in order to prevent them from touching any part of the tubular element (e.g. the XT spool) when the TH 1 is retrieved. FIG. 1 shows the coupling assembly 11 in a non-coupled state, i.e. with the coupling elements 17 in a retracted position. The process of moving the coupling elements 17 in said radial direction will be explained further below.

Figure 2:
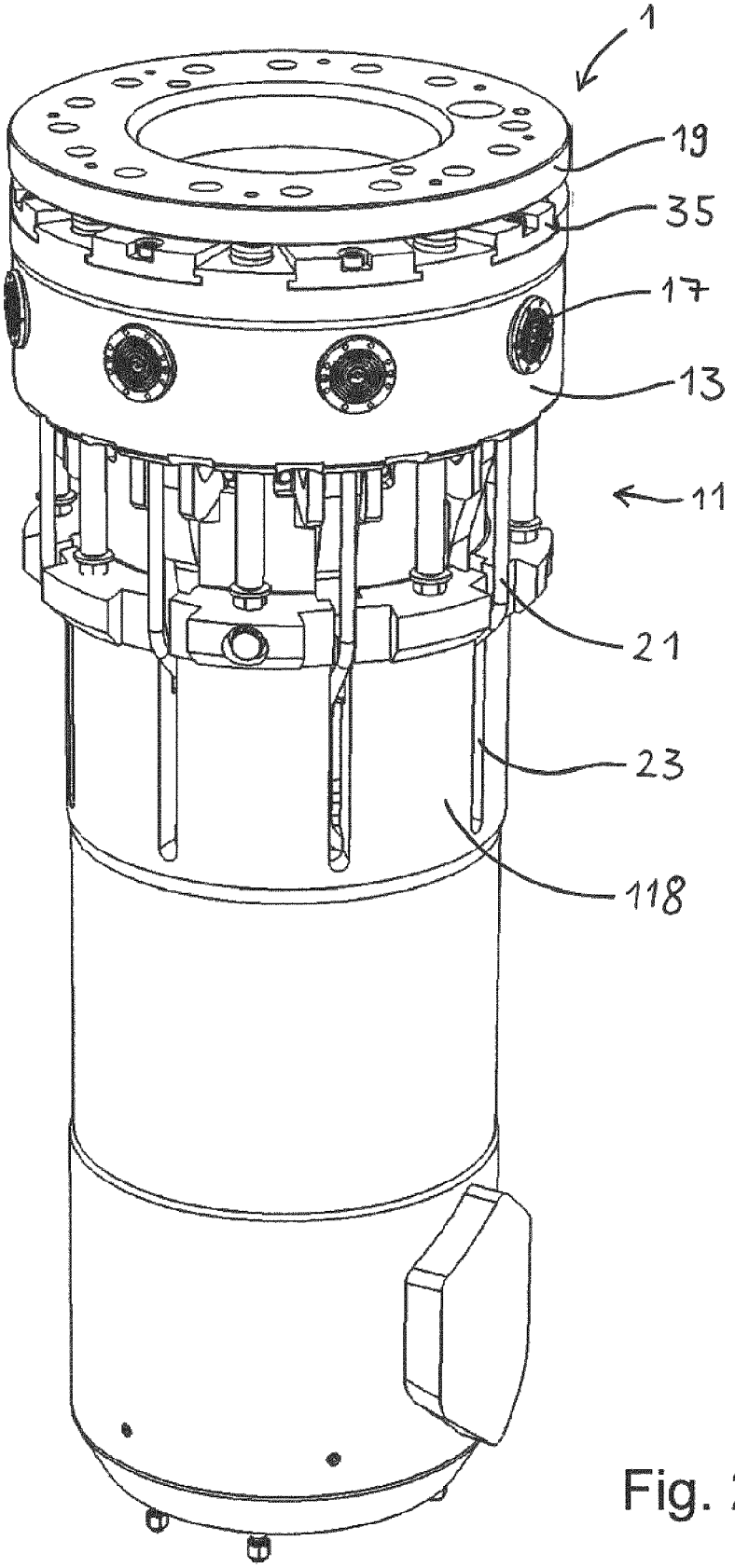
FIG. 2 shows the parts of FIG. 1, however with the coupling assembly in the coupled position.

FIG. 2 shows the same parts as FIG. 1, however with the coupling assembly in the coupled position, i.e. in the radially extended position. In the coupled position the main body 19 is in a lower position with respect to the carrier ring 13 than in the non-coupled position shown in FIG. 1.

Also shown in FIG. 1 and FIG. 2 are a plurality of hydraulic lines (pipes) 21 which extend from the lower part of the TH 1 to the coupling elements 17. A part of the hydraulic lines 21 are arranged in slits 23 in the orientation sleeve 118. The hydraulic lines 21 are sufficiently flexible to allow for the radial movement of the coupling elements 17 during coupling and decoupling.

Figure 3:
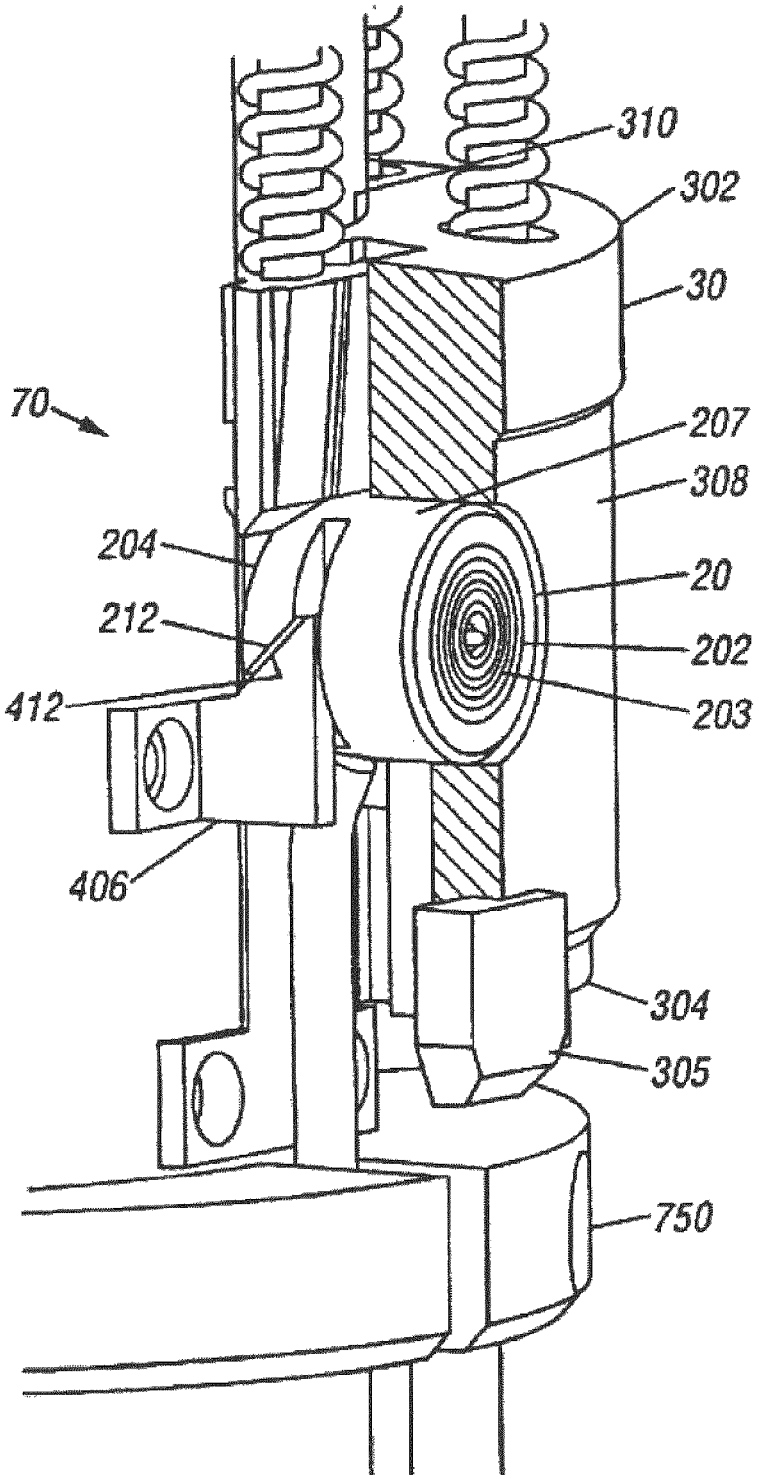
Fig. 3 Prior Art
FIG. 3 is a perspective view of a coupling assembly according to the prior art.
Figure 12:
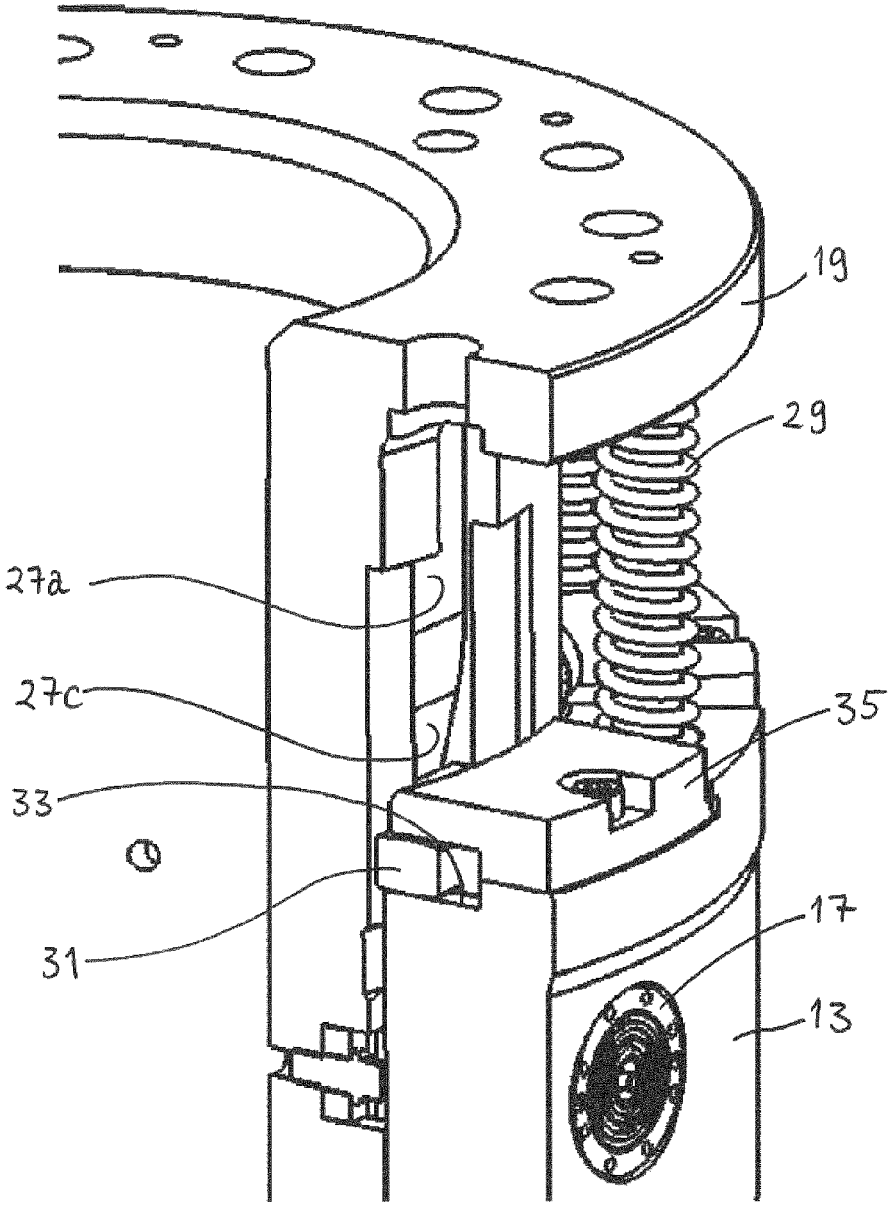
FIG. 12 is a perspective cutaway view of parts of the coupling assembly.

FIG. 3 is a perspective view of a prior art solution (FIG. 12 of U.S. Pat. No. 6,158,716). As with the coupling assembly 11 according to the present invention, the prior art solution has a carrier ring (30) with holes. In each of the holes there is a coupling element (20) adapted to be forced out in a radial direction in order to make a sealing coupling with a facing counterpart. Furthermore, as with the coupling assembly 11 according to the present invention, the prior art solution shown in FIG. 3 is adapted to maintain a pre-load on the coupling element in the radial direction, when the coupling element is in the coupled position. In the prior art solution, however, the pre-load is based on friction, whereas another technique is used in the coupling assembly 11 according to the present invention. For an explanation of the prior art pre-load solution it is referred to the publication. The solution according to the present invention will be described in the following.

The process of moving and preloading the coupling elements 17 into the coupled position will now be described with reference to FIG. 4 to FIG. 7. FIG. 4 shows a cross section side view of parts of the coupling assembly 11 (left) which has landed inside the spool 101 of a XT (right) of a subsea well. Also shown is a section of an upper part 1*a* of the tubing hanger 1. In the spool 101 is a through hole 103 in which there is arranged a penetrator 105 with a hydraulic channel 107. At the radially inner side of the penetrator 105 (left hand side in FIG. 4) the penetrator 105 exhibits a channel mouth 109 surrounded by a sealing surface 111. The object of the coupling assembly 11 in the TH 1 is to move and preload the coupling element 17 radially outwards from the retracted non-coupled position shown in FIG. 4 to the extended coupled position in which the coupling element 17 abuts and seals against the sealing surface 111 of the penetrator 105.

Down from the coupling element 17 extends the hydraulic line 21. The hydraulic line 21 communicates with a hydraulic channel 21*a* within the coupling element 17. When the TH 1 has landed, a coupling element mouth 21*b* is aligned with and faces the channel mouth 109 of the penetrator 105. Thus, when the coupling element 17 is moved radially outwards (towards the right in FIG. 4) a hydraulic communication will be established between the hydraulic line 21 and the hydraulic channel 107 in the penetrator 105.

Radially within the coupling element 17 is arranged an actuation element 25 and radially within the actuation element 25 is an actuation arrangement in the form of an axially movable actuation portion 27. In this embodiment the axially moving actuation portion 27 is a part of the main body 19. Also shown in FIG. 4 (as well as in FIG. 1) is one of a plurality of spiral springs 29, the purpose of which will be explained further below.

Figure 7:
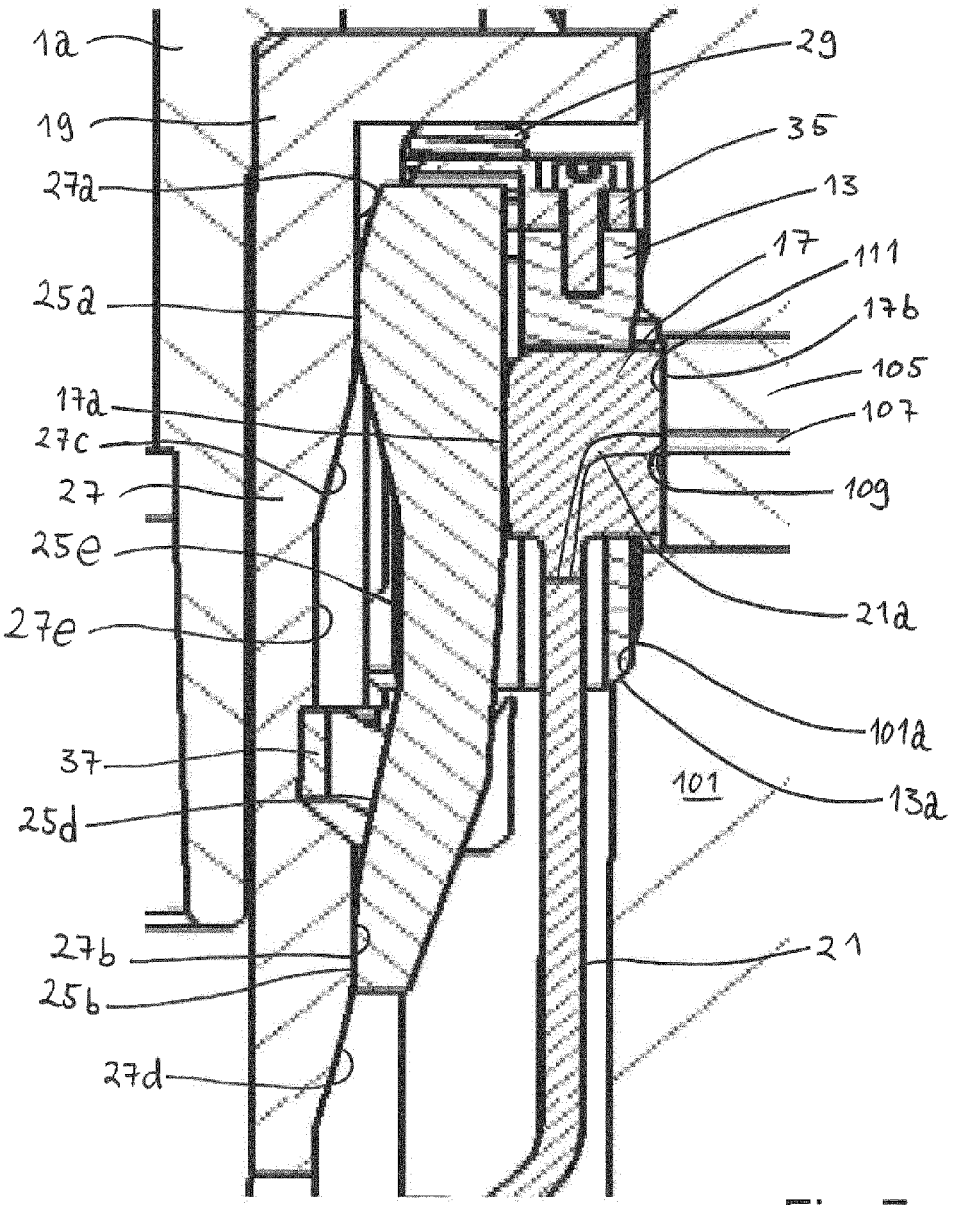
FIG. 7 is the same cross section view as FIG. 5 and FIG. 6, however with the coupling assembly in a coupled state.

FIG. 5, FIG. 6, and FIG. 7 show enlarged views of parts the coupling assembly 11 in a non-coupled state, an intermediate state, and in a coupled state, respectively. Referring first to FIG. 5, when the TH 1 is landed in the spool 101 of the XT, a carrier ring landing surface 13*a* will engage a spool landing shoulder 101*a*. This prevents the carrier ring 13 to move further downwards within the spool 101. The main body 19 of the TH 1 will however continue to move further down within the spool 101. This further movement will make the axially movable actuation portion 27 slide downwards along the inner surface of the actuation element 25. The actuation element 25 is fixed in the axial direction, but can be moved in the radial direction to force and move the coupling element 17 radially outwards. In FIG. 4 and FIG. 5 the axially movable actuation portion 27 has not yet moved with respect to the actuation element 25, which thus is in the radially inner position. Thus the coupling element 17 is not in the coupled position. The coupling element 17 has an outer surface 17*b* adapted to abut against the sealing surface 111 of the penetrator 105. As appears from FIG. 5, the outer surface 17*b* has not yet come into contact with the sealing surface 111.

In the intermediate state shown in FIG. 6, however, the axially movable actuation portion 27 has been moved a distance downwards with respect to the carrier ring 13 and the actuation element 25. During this movement a first and second inclined surface 25*c*, 25*d* of the actuation element 25 are slid along facing and substantially parallel inclined surfaces 27*c*, 27*d* of the axially movable actuation portion 27. The radially outwardly directed movement of the actuation element 25 has moved the coupling element 17 into abutment with the facing sealing surface 111 of the penetrator 105. One should note that there is substantially no mutual movement between the coupling element 17 and the actuation element 25, as they until this point have moved together in the radial direction. The actuation element 25 exhibits a contact surface 25*f* which abuts and transmits the radially directed force onto the coupling element 17.

Still referring to the intermediate state shown in FIG. 6, although the coupling element 17 has been moved into abutment with the sealing surface 111 of the penetrator 105, the first and second actuation surfaces 25*c*, 25*d* of the actuation element 25 have still not slid all the way until to the end of the first and second inclined surfaces 27*c*, 27*d*. Thus, as the axially movable actuation portion 27 continues to move downwards, the upper and lower part of the actuation element 25 are forced an additional distance radially outwards.

Referring to the coupled state shown in FIG. 7, when the first and second inclined surfaces 25*c*, 25*d* of the actuation element 25 have slid beyond the facing first and second inclined surfaces 27*c*, 27*d* of the axially movable actuation portion 27, a first actuation surface 25*a* of the actuation element 25 enters into contact with a facing first supporting surface 27*a* of the axially movable actuation portion 27. Correspondingly, a second actuation surface 25*b* enters into contact with a second supporting surface 27*b* of the actuation portion 27. On the actuation element 25, the first actuation surface 25*a* is arranged in an upper first actuation section 25*x* of the actuation element 25, whereas the second actuation surface 25*b* is arranged at a lower second actuation section 25*y*. The first and second inclined surfaces 25*c*, 25*d* of the actuation element 25, are also arranged in the first and second actuation sections 25*x*, 25*y*, respectively. The contact surface 25*f* abutting the coupling element 17 (i.e. abutting the coupling element inner surface 17*a*, cf. FIG. 10), is arranged at a mid section of the actuation element 25 and has a distance to both the first and second actuation sections 25*x*, 25*y*.

The person skilled in the art will now appreciate, by referring to FIG. 4 to FIG. 7, that the first and second actuation surfaces 25*a*, 25*b* of the actuation element 25 have been moved a further radial distance than the contact surface 25*f* has. This results in a pre-tensioning of the coupling element 17 in the radial outward direction. In the coupled state the actuation element 25 will thus function as a preloaded leaf spring.

Figure 8:
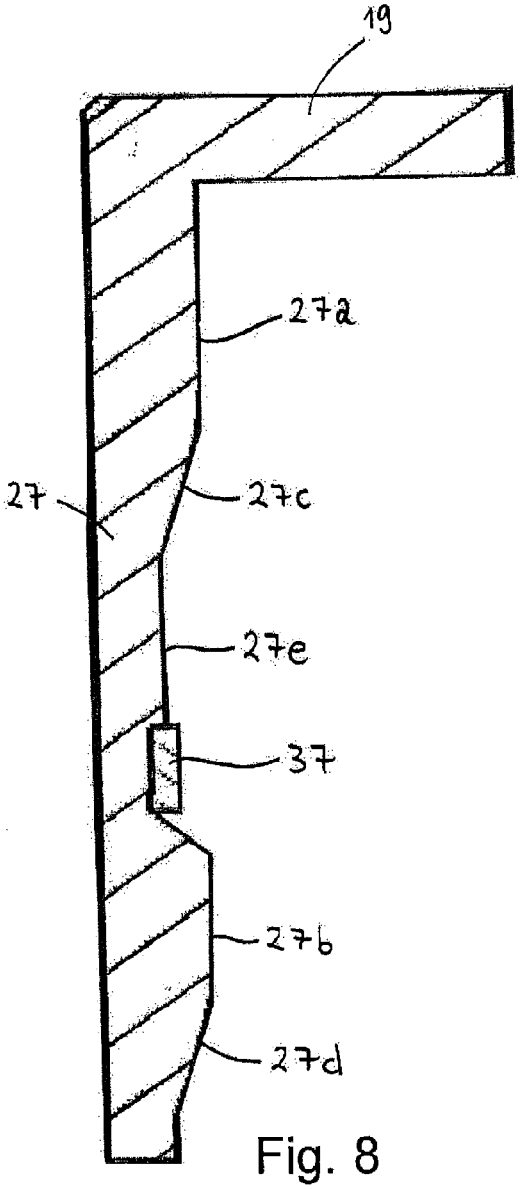
FIG. 8 is a stand-alone cross section view of a movable actuation portion of the main body.

For the sake of clarity, FIG. 8 and FIG. 9 show stand-alone cross section views of the axially movable actuation portion 27 and the actuation element 25, making the positions of the various surfaces more visible. At the mid section of the axially movable actuation portion 27 there is an outward facing passive surface 27*e*. Correspondingly, at the mid section of the actuation element 25 there is an inward facing passive surface 25*e*. One should note that during actuation of the coupling element 17, i.e. during movement of the actuation element 25 from the non-coupled state of FIG. 5 to the coupled state of FIG. 7, the actuation element 25 substantially does not alter its orientation, only its position. That is, it does not pivot. As mentioned above, however, its shape will be slightly altered during the preload function, however only in an elastic manner.

Figure 9A:
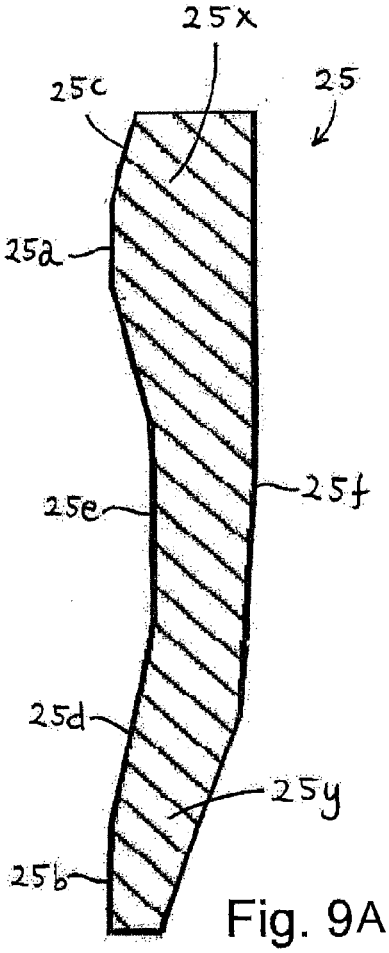
FIG. 9A is a stand-alone cross section view of an actuation element of the coupling assembly.
Figure 9B:
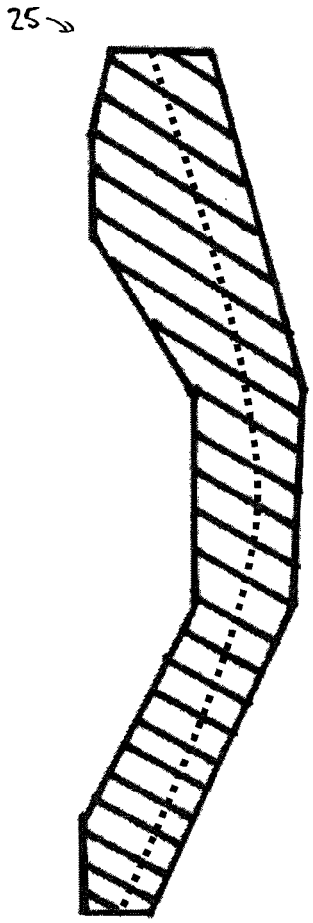
FIGS. 9B-9D are cross section views of the actuation element of FIG. 9A illustrating elastic and plastic deformation thereof.
Figure 9C:
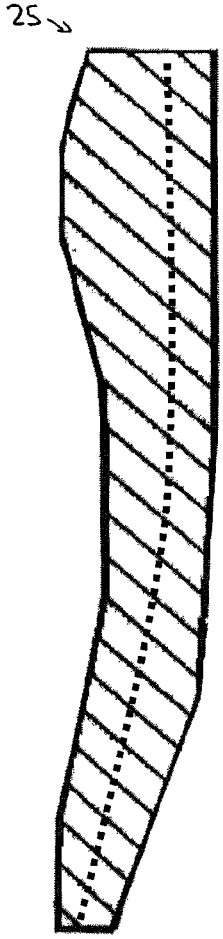
Figure 9D:
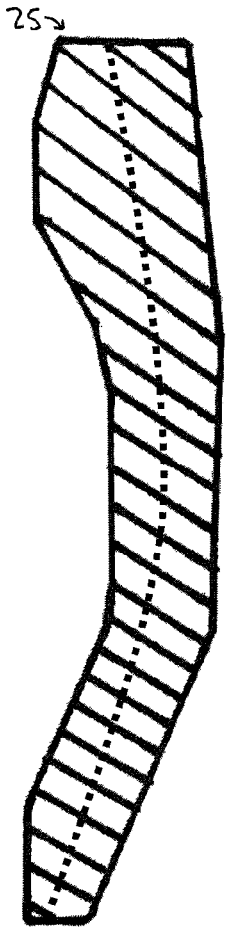

One could also imagine an actuation element (in the form of a leaf spring) that is able to deform plastically during the first assembly. In such a case the plastic deformation could account for and adopt to the individual tolerances of each unique tubing hanger. One would then have to ensure that the actuation element has the ability to have a sufficient remaining elastic range after being plastically deformed. Elastic and plastic deformation of the actuation element 25 is illustrated in FIGS. 9B-9D with FIG. 9B illustrating a resting state, FIG. 9C illustrating an elastically-deformed state, and FIG. 9D illustrating a plastically-deformed state.

Figure 10:
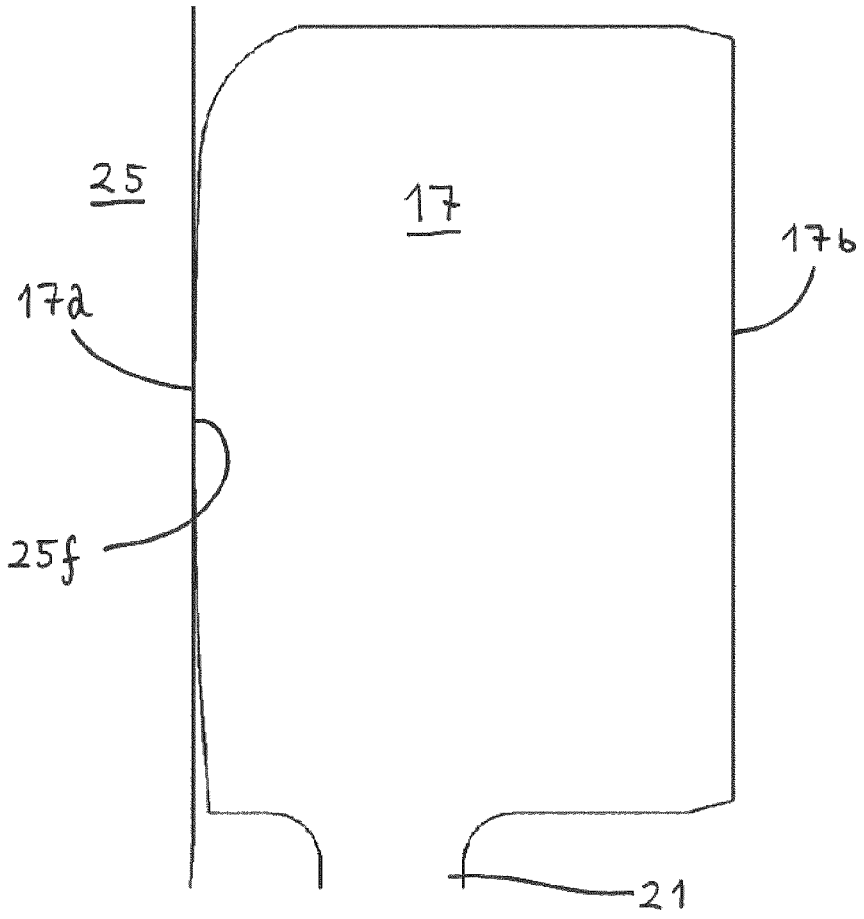
FIG. 10 is an enlarged cross section view of a coupling element of the coupling assembly.

FIG. 10 shows a principle sketch of the coupling element 17 in contact with the contact surface 25*f* of the actuation element 25. The coupling element 17 is on its radially inner surface provided with an inner actuation surface in the form of a coupling element inner surface 17*a* which abuts the contact surface 25*f*. The coupling element inner surface 17*a* has a spherical surface or a curved surface adapted to contact the contact surface 25*f* of the actuation element 25 substantially at the centre part of the coupling element inner surface 17*a*. This feature ensures that the force from the actuation element 25 onto the coupling element 17 remains substantially at the centre portion of the coupling element inner surface 17*a*, even if there should be a small change of angle between the two parts. Moreover, this feature ensures that the resultant force from the coupling element 17 onto the sealing surface 111 of the penetrator 105 also will be located substantially at the central portion. This provides an even force distribution on the sealing surfaces (or seals) adapted for sealing the coupling between the coupling element 17 and the penetrator 105.

Instead of having the coupling element inner surface 17*a* spherically shaped or curved, one could have the contact surface 25*f* of the actuation element curved or spherical. However, one would then have to ensure that the apex of the contact surface 25*f* will indeed contact the coupling element 17 at its center portion.

Encircling the coupling element mouth 21*b* there may be arranged seals adapted for sealing against the sealing surface 111 of the penetrator 105.

Figure 11:
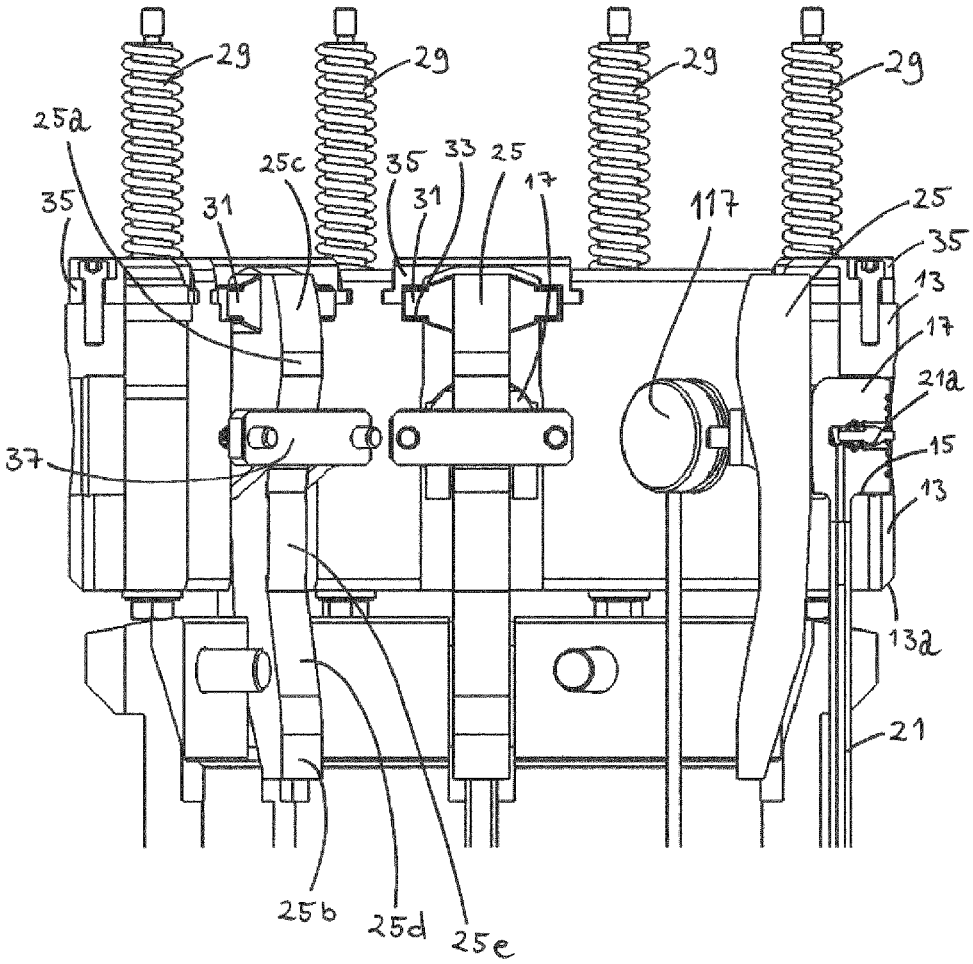
FIG. 11 is a side view of the inner face of a carrier ring of the coupling assembly.

FIG. 11 shows some parts of the coupling assembly 11, seen from the radial inside of the carrier ring 13. At the right hand side of FIG. 11, one can see how the coupling element 17 is arranged in a hole 15 of the carrier ring 13 and capable of moving a distance in the radial direction. The hydraulic channel 21*a* in the coupling element 17 is also indicated, and has connection to the hydraulic line 21. Radially within the coupling element 17 the actuation element 25 is shown. In addition to the three shown coupling elements 17, an electrical coupler 117 is also shown. This coupler is however not engaged by an actuation element of the kind actuating the other coupling elements 17. For illustrational purpose one of the actuation elements 25 is removed in this drawing.

Further to the left in FIG. 11 there are shown two additional actuation elements 25. In this view one can see that they are provided with two protruding pins 31 at their upper end. The protruding pins 31 each extends into a retaining groove 33 which ensures that the actuation element 25 will not move in the axial direction, but allows it to move in the radial direction. The retaining groove 33 is constituted by a portion of the carrier ring 13 and a retaining element 35 which is fixed to the carrier ring 13 with a bolt. A retracting member 37 is attached to the main body 19. The retracting member 37 is arranged for pulling the coupling element 17 and the actuation element 25 radially inwards during retrieval of the tubing hanger 1. This will be discussed below under reference to FIG. 13 and FIG. 14.

FIG. 12 is an enlarged perspective cross section view of parts of the coupling assembly 11. The plurality of spiral springs 29, which are also shown in other drawings, are biased to keep the coupling assembly 11 in the non-coupled state (cf. FIG. 5). In this way, when the tubing hanger 1 has not landed in the spool 101, the coupling elements 17 are in the retracted position within the holes 15 of the carrier ring 13.

Figure 13:
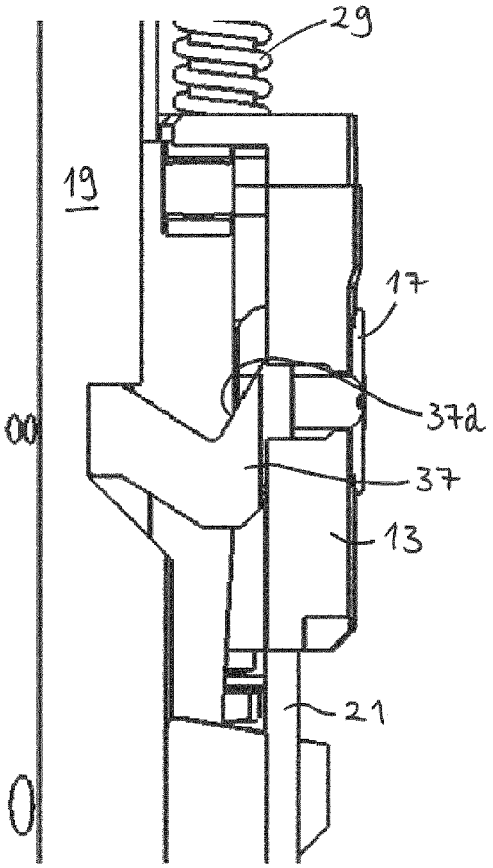
FIG. 13 is a cross section side view of parts of the coupling assembly in a coupled state.
Figure 14:
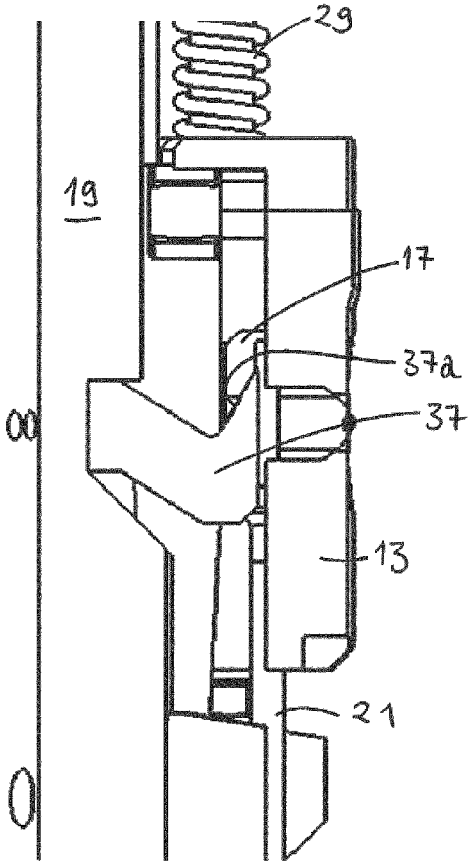
FIG. 14 is the same view as FIG. 13 in a non-coupled state.

FIG. 13 and FIG. 14 illustrate how the coupling elements 17 are retracted to the non-coupled state when the main body 19 moves upwards with respect to the carrier ring 13. This function is similar to the function described in the prior art publication U.S. Pat. No. 6,158,716 (cf. FIG. 3 of the present application). To the main body 19 there is attached a retracting member 37 which extends out from the main body 19. The retracting member 37 exhibits an inclined retracting surface 37*a* which is adapted to engage a facing inclined surface of the coupling element 17 when the main body 19 moves upwards with respect to the carrier ring 13. This mutual movement between the main body 19 and the carrier ring 13 is provided by the spiral springs 29 functionally arranged between the carrier ring 13 and the main body upper flange 19*a*. Hence, when retrieving the tubing hanger 1 one will not risk that any of the coupling elements 17 remain in the extended position (coupled position). FIG. 13 shows the coupling element 17 in a coupled position and FIG. 14 shows the coupling element 17 in a retracted position. Preferably, one retracting surface 37*a* is arranged on either side of the actuation element 25.

The coupling assembly 11 of the tubing hanger 1 according to the present invention may have one coupling element 17 or more coupling elements 17, for instance 2, 3 or 5, or even more. Furthermore, it may be a tubing hanger 1 adapted for a subsea well. However the tubing hanger 1 may also be adapted for an onshore well.

In stead of an axial movement of the actuation portion 27 with respect to the actuation element 25, one may also imagine a tangential direction of the movement. For instance, an actuation ring arranged radially within the actuation elements may be provided with inclined surfaces which engage the actuation element when the actuation ring is rotated about the centre axis with respect to the carrier ring. The functional surfaces (25*a*', 25*b*', 25*c*', 25*d*') of the actuation element 25' would then be arranged along a horizontal plane, i.e. a plane normal to the axis of the tubular element (or spool 101).

One can also imagine another actuation element (25) which is made to pivot in a radially outward direction in order to exert force and movement onto the coupling element. The actuation element would then be forced from within at a pivot section and an actuation section, and would exert force onto the coupling element from a section between these two sections.

The invention claimed is:

1. A tubing hanger adapted to land in a tubular element and comprising a coupling assembly adapted for establishment of a hydraulic coupling between the tubing hanger and the tubular element, wherein the coupling assembly comprises:

a coupling element adapted to move radially between an outer coupled position and an inner non-coupled position, which coupling element exhibits an outer surface adapted to establish said hydraulic coupling with an opposite and inwardly facing surface of the tubular element when forced against it, as the coupling element comprises a hydraulic channel adapted to align with a hydraulic channel in the tubular element, and wherein the coupling element comprises a radially inner actuation surface;

an actuation element with a contact surface adapted to exert an actuation force onto the inner actuation surface in a radially outward direction;

wherein the actuation element exhibits an elongated shape and comprises two actuation sections which are adapted to be exposed to a radially outward directed force from an actuation arrangement;

wherein the contact surface is arranged with a distance crosswise to the radially outward direction from both of said actuation sections; and wherein the actuation element is adapted to be moved in the radial outward direction in such way that the movement in the radial outward direction of at least one of the two actuation sections stops after radial movement of the contact surface stops, wherein the movement of the contact surface is halted as the coupling element reaches the coupled position.

2. Tubing hanger according to claim 1, wherein the actuation element comprises two parallel inclined surfaces adapted to slide simultaneously along two facing inclined surfaces of the actuation arrangement.

3. Tubing hanger according to claim 1, wherein the contact surface of the actuation element or the inner surface of the coupling element exhibits a spherical or convex, curved shape.

4. Tubing hanger according to claim 1, wherein in a coupled position two supporting surfaces of the actuation arrangement are adapted to abut against oppositely arranged and parallel extending actuation surfaces of the actuation element, of which parallel extending actuation surfaces one is arranged on each actuation section.

5. Tubing hanger according to claim 4, wherein the supporting surfaces of the actuation arrangement and the actuation surfaces of the actuation element are parallel with an axially extending center axis of the tubing hanger.

6. Tubing hanger according to claim 1, wherein during a first actuation of the coupling assembly, the actuation element is adapted to deform both in an elastic and plastic manner when the at least one of the two actuation sections moves a distance after the movement of the contact surface has stopped.

* * * * *